US010384822B2

(12) United States Patent
Schieck et al.

(10) Patent No.: US 10,384,822 B2
(45) Date of Patent: Aug. 20, 2019

(54) PALLET WRAP MACHINE MONITOR

(71) Applicant: Crawford Packaging Inc., London (CA)

(72) Inventors: Martin J. Schieck, London (CA); John W. Ashby, London (CA); Samuel J. Capson, St. Thomas (CA)

( * ) Notice: Subject to any disclaimer, the term of this patent is extended or adjusted under 35 U.S.C. 154(b) by 458 days.

(21) Appl. No.: 15/383,089

(22) Filed: Dec. 19, 2016

(65) Prior Publication Data

US 2017/0101205 A1 Apr. 13, 2017

Related U.S. Application Data

(63) Continuation of application No. PCT/CA2015/050571, filed on Jun. 19, 2015.

(60) Provisional application No. 62/014,254, filed on Jun. 19, 2014.

(51) Int. Cl.

| | |
|---|---|
| ***B65B 57/04*** | (2006.01) |
| ***B65B 11/02*** | (2006.01) |
| ***B65B 11/04*** | (2006.01) |
| ***B65B 41/12*** | (2006.01) |

(52) U.S. Cl.

CPC ..... *B65B 57/04* (2013.01); *B65B 11/025* (2013.01); *B65B 11/045* (2013.01); *B65B 41/12* (2013.01); *B65B 2210/20* (2013.01)

(58) Field of Classification Search

CPC ..... B65B 11/02; B65B 11/025; B65B 11/04; B65B 11/045; B65B 41/12; B65B 41/16; B65B 57/04; B65B 2011/002; B65B 2210/14; B65B 2210/20; G01B 5/043; G01B 7/042; G01B 21/06; G01B 21/065

USPC ..... 53/397, 399, 441, 64, 556, 587, 588, 53/389.4

See application file for complete search history.

(56) References Cited

U.S. PATENT DOCUMENTS

| | | | | |
|---|---|---|---|---|
| 2,167,548 A * | 7/1939 | Hudson | ..... | G01B 7/042 72/11.2 |
| 3,429,504 A * | 2/1969 | Golner | ..... | G01B 21/06 226/11 |
| 4,754,593 A * | 7/1988 | Ishihara | ..... | B65B 41/18 53/51 |
| 5,388,387 A * | 2/1995 | McElvy | ..... | B65B 41/16 156/502 |

(Continued)

FOREIGN PATENT DOCUMENTS

| | | | | |
|---|---|---|---|---|
| EP | 0096635 A2 * | 12/1983 | ..... | B65B 11/045 |
| EP | 0144266 A2 * | 6/1985 | ..... | B65B 11/045 |

(Continued)

OTHER PUBLICATIONS

International Search Report and Written Opinion on PCT/CA2015/050571 dated Sep. 1, 2015.

*Primary Examiner* — Stephen F. Gerrity
(74) *Attorney, Agent, or Firm* — Brunet & Co. Ltd.

(57) ABSTRACT

A system, method and kit permitting more accurate determination of film usage in a pallet wrap machine involves rotary encoders that engage with the actual film, rather than a pre-stretch or stretch roller. At least one rotary encoder engages with unstretched film before a pre-stretch roller takes up the film and at least one rotary encoder engages with stretched film after the film leaves the stretch roller. Slippage of the film on the rollers, which is a common occurrence, is not a factor that affects the data generated by the rotary encoders.

14 Claims, 4 Drawing Sheets

(56) References Cited

U.S. PATENT DOCUMENTS

| | | | | |
|---|---|---|---|---|
| 5,485,712 | A * | 1/1996 | Cherney et al. | B65B 41/16 53/436 |
| 6,772,574 | B1 * | 8/2004 | Edstrom | G01B 21/06 100/2 |
| 7,178,317 | B1 * | 2/2007 | Koskela | B65B 11/045 242/597.8 |
| 8,001,745 | B2 | 8/2011 | Carter et al. | |
| 2003/0233811 | A1 * | 12/2003 | Hendriks et al. | B65B 41/16 53/133.4 |
| 2010/0313525 | A1 * | 12/2010 | Martin et al. | B65B 11/025 53/461 |
| 2014/0116008 | A1 | 5/2014 | Lancaster, III et al. | |
| 2014/0331878 | A1 * | 11/2014 | Dawley et al. | G01B 21/06 101/219 |
| 2015/0075120 | A1 * | 3/2015 | Schablin et al. | B65B 11/025 53/556 |

FOREIGN PATENT DOCUMENTS

| | | | | |
|---|---|---|---|---|
| EP | 0246659 | A1 * | 11/1987 | B65B 11/045 |
| WO | 2013/124836 | A1 | 8/2013 | |
| WO | 2015/040585 | A1 | 3/2015 | |
| WO | 2015/082945 | A1 | 6/2015 | |

* cited by examiner

PALLET WRAP MACHINE MONITOR

CROSS-REFERENCE TO RELATED APPLICATIONS

This application is a continuation of International Patent Application PCT/CA2015/050571 filed Jun. 19, 2015, which claims the benefit of U.S. patent application 62/014,254, filed Jun. 19, 2014, both of which are incorporated herein by reference.

FIELD

This application relates to packaging, in particular to apparatuses, methods and systems for monitoring and/or improving usage of stretch film on pallet wrap machines.

BACKGROUND

Pallet wrap machines are used to wrap stretch film around pallets to retain a product load on the pallet. The amount of stretch film usage is an important cost factor for a company, especially for a company with high volume wrapping requirements. It is therefore important to maintain optimized machine settings at all times in order to minimize film usage and keep film costs down.

However, stretch film usage using such machines can vary over time despite starting with optimal machine settings. Changes in the amount of film used can arise from a number of factors including machine wear and unauthorized adjustments to machine settings. It is therefore valuable to be able to monitor the amount of film being used to be able determine whether optimal usage is being maintained.

There are very few ways to determine the amount of film being used by a stretch wrapping machine. U.S. Pat. No. 8,001,745 issued Aug. 23, 2011, the contents of which are herein incorporated by reference, describes a system for monitoring and controlling usage of stretch film. This system involves the use of a rotary encoder collar securable to a pre-stretch roller of the wrapping machine, proximity sensors for counting revolutions of the rotary encoder and film detection sensors mounted proximate the center and the periphery of the film roller. However, because the rotary encoder collar monitors the rotation of the pre-stretch roller, the encoder does not directly measure the amount of film passing over the pre-stretch roller. There is only an implied relationship between the rotation of the pre-stretch roller and the length of film that passes over the roller, and this relationship may not accurately reflect the amount of film actually used due, at least in part, to slippage between the rollers of the machine and the film.

There remains a need to better monitor and control the use of stretch film in a pallet wrap machine.

SUMMARY

There is provided a system for monitoring and/or improving stretch film usage in a pallet wrap machine, the system comprising: a plurality of rotary encoders configured to be contactable with stretch film in a pallet wrap machine, at least one of the plurality of rotary encoders configured to contact unstretched stretch film and at least one of the plurality of rotary encoders configured to contact stretched stretch film in the pallet wrap machine; and, a controller in communication with the plurality of rotary encoders, the controller configured to receive rotational data generated by rotation of the rotary encoders, wherein the rotation of the rotary encoders is caused by engagement of the rotary encoders with the stretch film moving in the machine and the rotational data from any one rotary encoder is correlated to a length of stretch film that has passed by the any one rotary encoder, and wherein an amount of stretch film pulled off a roll of stretch film in the machine is determined from rotational data from the at least one rotary encoder configured to contact unstretched stretch film and/or an amount of stretching of the stretch film is determined by comparing the rotational data from the at least one rotary encoder configured to contact unstretched stretch film to rotational data from the at least one rotary encoder configured to contact stretched stretch film.

There is further provided a method for monitoring and/or improving stretch film usage in a pallet wrap machine, the method comprising: obtaining rotational data from a plurality of rotary encoders engaged with stretch film in a pallet wrap machine, at least one of the plurality of rotary encoders engaged with unstretched stretch film and at least one of the plurality of rotary encoders engaged with stretched stretch film in the pallet wrap machine; determining lengths of stretch film that have passed the rotary encoders from the rotational data; and, determining whether a roll of stretch film needs to be replaced from the length of stretch film that has passed the at least one rotary encoder engaged with unstretched stretch film, and/or determining whether stretch film usage is optimal by comparing the length of stretch film that has passed the at least one rotary encoder engaged with unstretched stretch film to the length of the stretch film that has passed by the at least one rotary encoder engaged with stretched stretch film.

There is further provided a kit for retrofitting a pallet wrap machine with a system for monitoring and/or improving stretch film usage in the pallet wrap machine, the kit comprising: a plurality of rotary encoders; a controller configured to be interfaced with the rotary encoders and programmed with software to interpret rotational data from the rotary encoders to produce logs based on the rotational data; and, instructions for installing the plurality of rotary encoders on the machine so that at least one of the plurality of rotary encoders is configured to contact unstretched stretch film and at least one of the plurality of rotary encoders is configured to contact stretched stretch film in the pallet wrap machine, and instructions for configuring the controller to be in communication with the rotary encoders.

Further features will be described or will become apparent in the course of the following detailed description. It should be understood that each feature described herein may be utilized in any combination with any one or more of the other described features, and that each feature does not necessarily rely on the presence of another feature except where evident to one of skill in the art.

BRIEF DESCRIPTION OF THE DRAWINGS

For clearer understanding, preferred embodiments will now be described in detail by way of example, with reference to the accompanying drawings, in which.

DETAILED DESCRIPTION

Figure 1A:
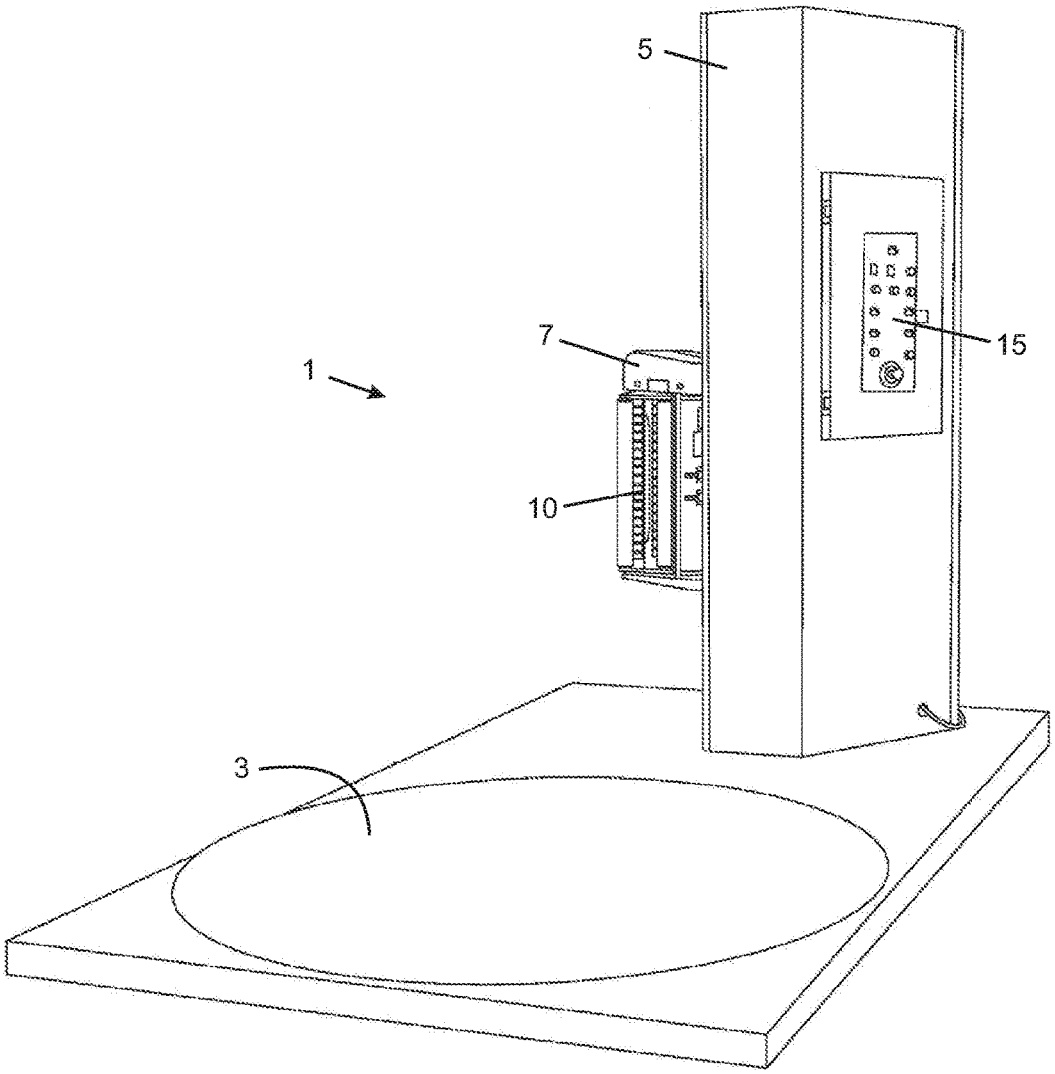
FIG. 1A is a schematic illustration of a first variation of a pallet wrap machine.

In some embodiments, the plurality of rotary encoders is two rotary encoders comprising a first rotary encoder configured to contact unstretched stretch film and a second rotary encoder configured to contact stretched stretch film. In some embodiments, the rotary encoders are configured to be contactable with the stretch film by mounting rotary encoder assemblies comprising the rotary encoders on mounting structures connected to one or more rollers in the machine. In some embodiments, the rotary encoder assemblies are spring-loaded to engage the rotary encoders with the stretch film during operation of the machine while permitting movement of the rotary encoders so that replacement of the roll of stretch film is unimpeded by the rotary encoders.

The controller may be, for example, a microprocessor embodied in a control apparatus. The controller may comprise a programmable logic controller. The programmable logic controller may be programmed with software to interpret rotational data from the rotary encoders to produce logs based on the rotational data collected from the rotary encoders. The programmable logic controller may be operatively linked to, for example in electronic communication with, a database of predetermined standards for the pallet wrap machine so that the rotational data collected from the rotary encoders may be compared to the predetermined standards. The programmable logic controller may be further operatively linked to a communication device, for example an e-mail client, cellular telephone, text messaging service and the like, so that deviations of the data collected from the rotary encoders in comparison to the predetermined standards may be signaled to a predetermined recipient to initiate corrective action at the pallet wrap machine. In some embodiments, the controller may be programmed to continuously or periodically send the rotational data to an off-site controller, data logger and/or user interface.

In some embodiments, an encoder interface may be employed for receiving the rotational data from the rotary encoders through wires. The encoder interface may be configured for wirelessly transmitting the rotational data to the controller. One or more cable harnesses may be used for routing the wires from the rotary encoders to the encoder interface. In the kit, instructions may be included for installing the encoder interface and the one or more cable harnesses.

Electronic communication between the rotary encoders and the controller, and the controller and other elements of the system may be provided through wires or wirelessly. The control apparatus may comprise, for example, a computer, an output device and an input device, the computer comprising a microprocessor for controlling operations and a non-transient electronic storage medium for storing rotational data and/or for storing computer executable code for carrying out instructions for implementing the method. The computer may further comprise a transient memory (e.g. random access memory (RAM)) accessible to the microprocessor while executing the code. A plurality of computer-based apparatuses may be connected to one another over a computer network system and geographically distributed. The system may therefore comprise means for transmitting the rotational data to a remote computer. One or more of the computer-based apparatuses in the computer network system may comprise a microprocessor for controlling operations and a non-transient electronic storage medium for storing rotational data from the rotary encoders and/or for storing computer executable code for carrying out instructions for implementing the method, and the computer-based apparatuses in the network may interact so that data collected from the rotary encoders may be stored and compared at remote locations. The output device may be a monitor, a printer, a device that interfaces with a remote output device or the like. The input device may be a keyboard, a mouse, a microphone, a device that interfaces with a remote input device or the like. With a computer, data may be a graphically displayed in the output device. There is also provided a computer readable non-transient storage medium having computer readable code stored thereon for executing computer executable instructions for carrying out the method.

The lengths of stretch film that have passed by the rotary encoders may be compared to benchmark values for an amount of stretch film that is expected to be used for the type of product or palletized load being wrapped. However, if the lengths of stretch film that have passed by the rotary encoders are inaccurately determined, wastage of film may occur. The present system, method and kit permit more accurate determination of film usage in a pallet wrap machine than other systems. Because the rotary encoders engage with the actual film, rather than a pre-stretch or stretch roller, slippage of the film on the rollers, which is a common occurrence, is not a factor that affects the data generated by the rotary encoders. In the present system, when the film stops moving so does the rotary encoder. In systems where the encoder is configured to be mounted on a roller, the encoder will continue to record movement even if the film is not moving, for example during slippage. Thus, the monitoring accuracy of the present system is improved.

Further, because at least one rotary encoder is engaged with the unstretched film before the film is taken up by the pre-stretch roller and at least one rotary encoder is engaged with the stretched film after the film leaves the, it is possible to accurately determine the ratio of lengths of stretched to unstretched film being used while the pallet wrap machine is operating. This provides information about whether the machine is properly stretching the film for a given application. This also provides real-time information about whether machine parameters have changed during the course of a wrapping operation that was correctly initiated but subsequently changed.

Figure 1B:
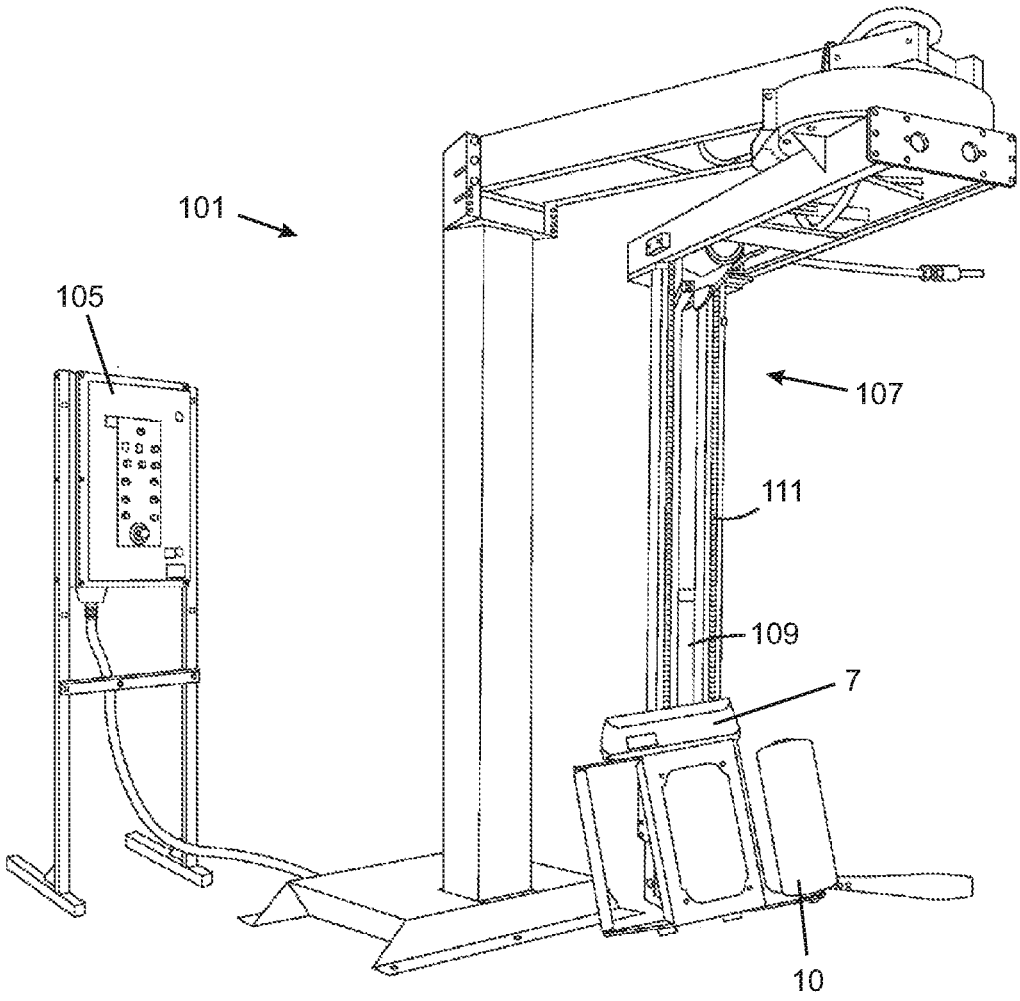
FIG. 1B is a schematic illustration of a second variation of a pallet wrap machine.

Examples of various pallet wrap machines in which the present invention may be useful are shown and described in U.S. Pat. Nos. 3,867,806, 4,050,221, 5,570,564, 4,502,264, 4,248,031 and 8,001,745, which are incorporated by reference herein in their entirety. FIG. 1A and FIG. 1B illustrate two such examples.

With reference to FIG. 1A, a first variation of a pallet wrap machine 1 involves rotating the product or load. The pallet wrap machine 1 may include a turntable 3 and a tower 5. The tower 5 may support a film delivery carriage 7 and a control panel 15. The turntable 3 rotates a product or palletized load for wrapping in stretch film while the film delivery carriage 7 delivers stretch film to be wrapped around the product or palletized load. The film delivery carriage 7 employs a roller arrangement 10 having a stretch film usage monitoring system as described in connection with FIG. 2 and FIG. 3. As the turntable 3 turns the product or load, the film delivery carriage 7 translates up and down on the tower 5 so that the sides of the product or load may be completely wrapped in stretch film. Rotation rate of the turntable, the number of revolutions of the turntable, film delivery rate, film tension, up and down translation of the film delivery system and any other parameter of the machine may be controlled by an operator from the control panel 15 or from a remote location.

With reference to FIG. 1B, a second variation of a pallet wrap machine 101 utilizes the same film delivery carriage 7 and the same roller arrangement 10 as the first variation, but the pallet wrap machine 101 is configured to rotate the film delivery carriage 7 around the product or load thereby dispensing stretch film via the roller arrangement 10 to wrap the product or load. In this variation, the product or load may be stationary or may also be rotated in an opposite direction to the direction of rotation of the film delivery carriage 7. The pallet wrap machine 101 is particularly useful for high speed operations or when the load is too heavy or unstable to rotate. To accomplish such wrapping, the pallet wrap machine 101 may have a rotary arm 107 on which the film delivery carriage 7 with roller arrangement 10 is supported. The rotary arm 107 is rotated around the product or load. The rotary arm 107 may comprise track 109 with the film delivery carriage 7 mounted on the track 109. Up and down movement of the film delivery carriage 7 on the track 109 may be accomplished with belt or chain 111 and operation of the machine 101 may be controlled from a control panel 105.

Figure 2:
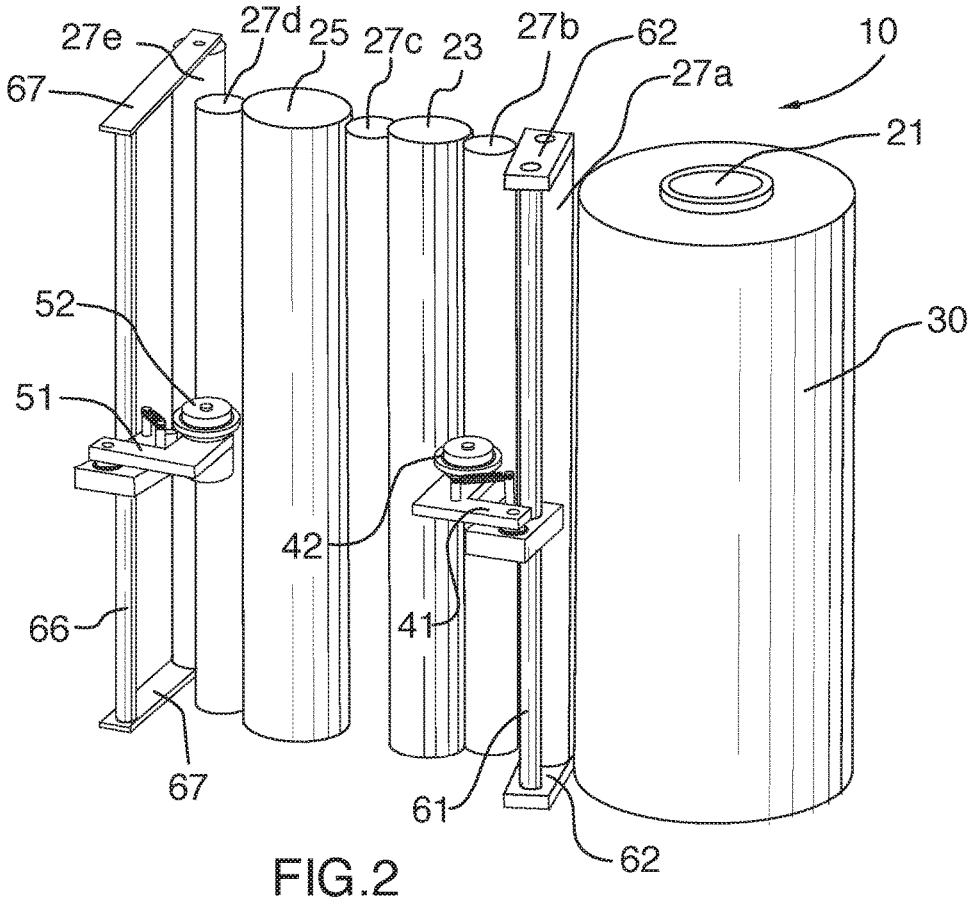
FIG. 2 is a schematic representation a roller arrangement in the pallet wrap machine of FIG. 1A or FIG. 1B equipped with one embodiment of a stretch film usage monitoring system in accordance with the present invention.
Figure 3:
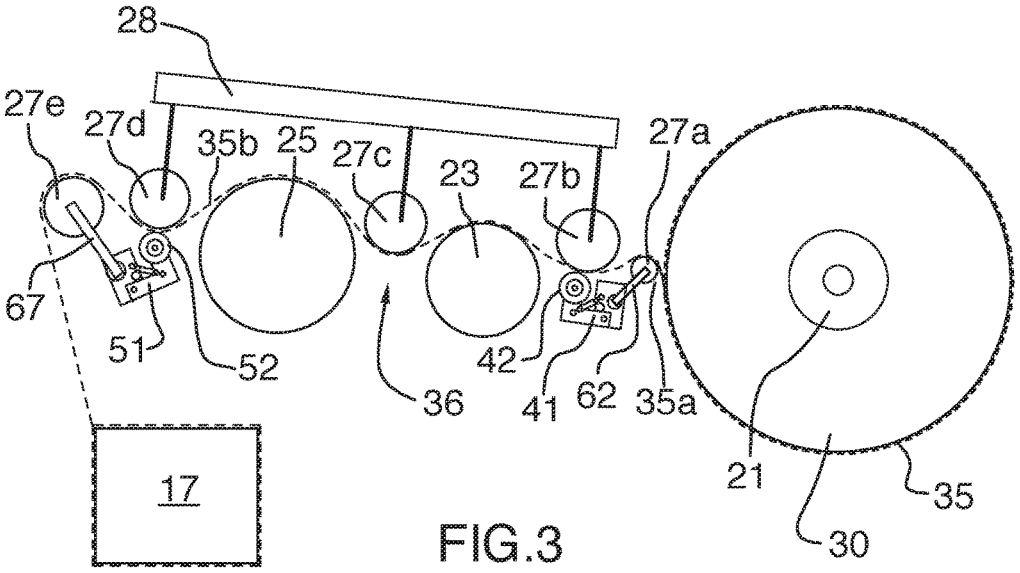
FIG. 3 is a top view of the arrangement illustrated in FIG. 2 showing the path of the stretch film as a dashed line between the rollers.

As shown in FIG. 2 and FIG. 3, the roller arrangement 10 of the stretch film delivery system comprises a series of vertically oriented cylindrical rollers including a film roller 21, a primary pre-stretch roller 23, a secondary pre-stretch roller 25 and a plurality of idler rollers 27*a-e*, including a first idler 27*a*, three gate idlers 27*b*,27*c*,27*d* and a dancer 27*e*. The three gate idlers 27*b*,27*c*,27*d* are mounted to a carriage gate 28, which may be moved to move the gate idlers 27*b*,27*c*,27*d* away from the film path. A coil 30 of stretch film 35 may be placed on the film roller 21. The stretch film 35 follows a serpentine path through the series of rollers from the film roller 21 out past the last dancer 27*e* to the product or palletized load 17 on the turntable. Although not necessarily needed, the idler rollers 27*a-e* are useful to help guide the film 35 as the film 35 is being applied to the product or palletized load. The idler rollers 27*a-e* also help maintain tension in the film 35 and help increase contact area between the film 35 and the pre-stretch rollers 23,25, which helps reduce film slippage on the pre-stretch rollers 23,25.

Referring especially to FIG. 3, in operation, a rotating product or palletized load 17 on the rotating turntable provides motive force for drawing the film 35 (shown in dashed line) to the product or palletized load 17 to be wrapped around the product or palletized load 17. To ensure that the film 35 is drawn at an even rate, to maintain even tension on the drawn film to reduce film breakage and to stretch the film 35 to reduce film usage, the pre-stretch rollers 23,25 may assist in removal of the film 35 from the film's coil 30. To this end, the primary pre-stretch roller 23 and the secondary pre-stretch roller 25 may be motorized so that they are rotated by one or more motors. The primary pre-stretch roller 23 is rotated by the motor at a slower circumferential speed than the secondary pre-stretch roller 25. The difference in circumferential speed may be accomplished using two motors each independently driving one of the pre-stretch and stretch rollers. However, it may be simpler, cheaper and more energy efficient to use one motor with a gear system and/or pre-stretch rollers having different diameters linked to the motor by belts, chains or pulleys. Preferably, both pre-stretch rollers 23,25 are driven by a single motor with the rollers gear driven by a belt, chain or pulley system that creates the proper circumferential speed ratio and pre-stretch parameters. Altering the speed ratio and pre-stretch parameters may be accomplished by changing the gears.

Both pre-stretch rollers may be designed to grip or hold the film as it stretches. The primary pre-stretch roller 23 operates to draw raw unstretched film 35*a* from the coil 30 and then move the raw film 35*a* into a stretch zone 36 between the primary pre-stretch roller 23 and the secondary pre-stretch roller 25. Because the secondary pre-stretch roller 25 has a circumferential speed that is greater than the circumferential speed of the primary pre-stretch roller 23, the raw film 35*a* becomes stretched in the stretch zone 36 to form stretched film 35*b*. The primary pre-stretch roller 23 and secondary pre-stretch roller 25 may be rotated so that the circumferential speed of the secondary pre-stretch roller 25 is about three times that of the primary pre-stretch roller 23. This results in the film stretching about 250-300%. Adjusting the circumferential speeds of the primary pre-stretch roller 23 and secondary pre-stretch roller 25 to achieve about 250% stretching results in less film breakage but more film usage, while adjusting the circumferential speeds to achieve about 300% stretching results in less film usage but potentially more film breakage. After leaving the secondary pre-stretch roller 25, the stretched film 35*b* is then guided out to the rotating product or palletized load 17 to be wrapped around the product or palletized load 17.

Figure 5:
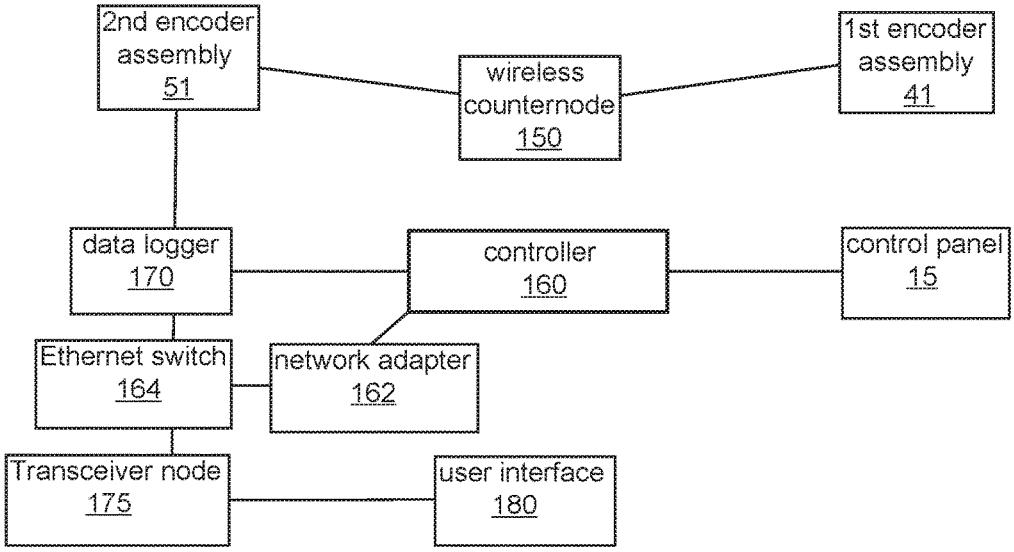

Referring to FIG. 2, FIG. 3 and FIG. 5, to track film usage, a stretch film monitoring system 75 is employed. In one embodiment, the stretch film monitoring system 75 comprises first and second encoder assemblies 41, 51 having first and second rotary encoders 42, 52 in communication with a controller 160. The first encoder assembly 41 comprises a first rotary encoder 42 positioned to contact the raw film 35*a* against the gate idler 27*b* before the raw film 35*a* is taken up by the primary pre-stretch roller 23. Movement of the raw film 35*a* past the first rotary encoder 42, which is in contact with the raw film 35*a*, causes the first rotary encoder 42 to rotate and rotational data from the first rotary encoder 42 is sent to the controller 160 where the rotational data is converted into film length data and the data is logged. The second encoder assembly 51 comprises a second rotary encoder 52 positioned to contact the stretched film 35*b* against the gate idler 27*d* as the stretched film 35*b* comes off the secondary pre-stretch roller 25. Movement of the stretched film 35*b* past the second rotary encoder 52, which is in contact with the stretched film 35*b*, causes the second rotary encoder 52 to rotate and rotational data from the second rotary encoder 52 is sent to the controller 160 where the rotational data is converted into film length data and the data is logged. Because the rotary encoders are in contact with the film rather than with the pre-stretch and stretch rollers, stoppage in the actual film is recorded whether or not the rollers continue to rotate. Film usage data collected using the present monitoring system is more accurate than data collected by measuring rotation of the rollers, in part because film slippage can be accounted for by the present system and two encoders are used, one to measure movement of the raw film and the other to measure movement of the stretched film.

Figure 4:
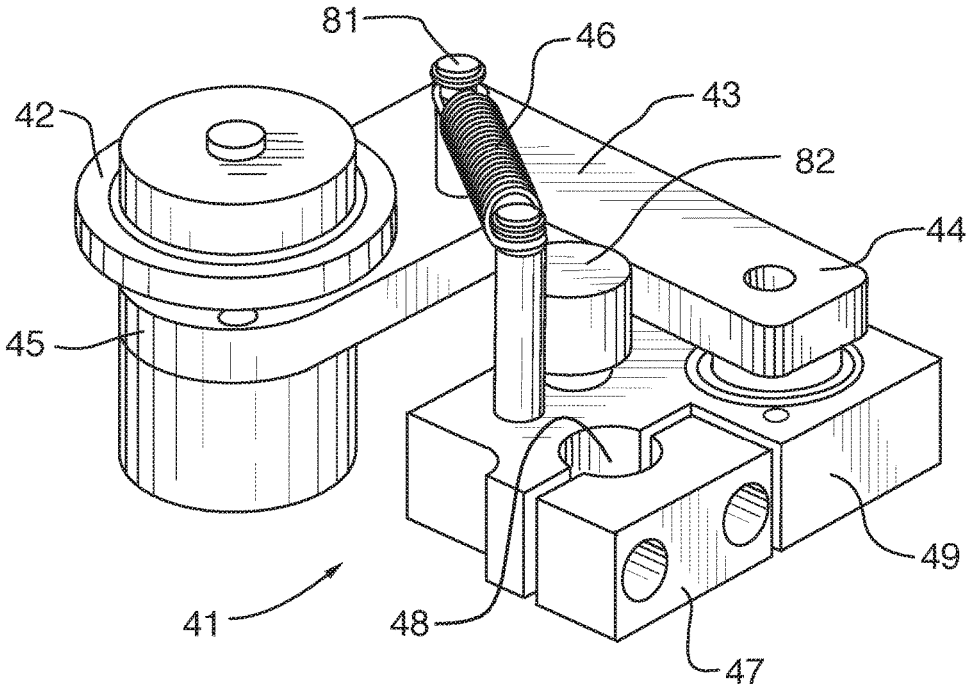
FIG. 4 is a schematic illustration of an encoder assembly used in the film usage monitoring system; and, FIG. 5 is a block diagram of a system for monitoring stretch film usage in a pallet wrap machine.

The first and second encoder assemblies 41, 51 may be mounted on respective mounting posts 61, 66 apart from the pre-stretch and stretch rollers 23, 25. The mounting posts 61, 66 may be secured with brackets 62, 67 to idler rollers 27*a*, 27*e* respectively, although any arrangement for securing the first and second encoder assemblies 41, 51 in the appropriate positions close to the film may be employed. With reference to FIG. 4, one embodiment of the first encoder assembly 41 is depicted, which is applicable to the second encoder assembly 51 as well. The encoder assembly 41 comprises a spring-loaded L-shaped armature 43 pivotally mounted at a first end 44 of the armature 43 to a mounting block 49. The rotary encoder 42 is mounted through a second end 45 of the armature 43. The mounting block 49 comprise a through aperture 48 through which the mounting post 62 can extend and the mounting block 49 may be secured to the mounting post 62 by a clamp 47 formed of a portion of the mounting block bolted to another portion of the mounting block. A spring 46 extending between and secured to spring posts 81 mounted on the armature 43 and mounting block 49 biases the armature toward stop 82. The spring 46 permits moving the armature 43 and therefore the rotary encoder 42 away from the path of the film to facilitate replacement of the roll of film in the carriage when the roll runs out of film.

With reference to FIG. 5 in particular, the system 75 for monitoring stretch film usage comprises the first and second encoder assemblies 41, 51 in communication with a wireless counter node 150, for example an Xbee wireless send and receiver board. The counter node 150 receives data from the encoder assemblies 41, 51 usually through a wired connection. Wired connections from the encoder assemblies 41, 51 may be routed through the pallet wrap machine in a safe path with the aid of one or more cable harnesses. Data may be transmitted wirelessly from the counter node 150 to the controller 160, the counter node 150 and the controller 160 comprising antennas for receiving and sending wireless electronic transmissions. Alternatively, the first and second encoder assemblies 41, 51 may be hardwired directly to the controller 160 in which case the wireless counter node 150 may be omitted. The controller 160, for example a computer, may comprise an input/output (i/o) board for interpreting data received from and sent to the wireless counter node 150. The controller 160 may further comprise a programmable logic controller (PLC) programmed with software to interpret information from the encoders and to produce logs in a data logger 170 that may be extracted as files for use in data handling software. The data in the data logger may be stored and reviewed through a user interface associated with the controller 160, or may be sent continuously or periodically to an off-site controller, data logger and/or user interface 180, for example through a transceiver node 175 and the internet or cellular networks. In one embodiment, the controller 160 may communicate with the off-site controller, data logger and/or user interface 180 through a network adapter 162 and the transceiver node 175. As shown in FIG. 5, the data logger 170 and controller 160 may both be configured to communicate with the off-site controller, data logger and/or user interface 180, in which case an Ethernet switch 164 in communication with the data logger 170 and controller 160 and the transceiver node 175 may be required. A power supply, for example an uninterruptible power supply (UPS), with appropriate fusing may be used to power the controller 160 and/or other elements of the system 75, or to act as a back-up power supply. In some embodiments, the controller 160 can be physically attached to or incorporated into the control panel 15, along with one or more other elements of the system 75 for monitoring stretch film usage.

The novel features will become apparent to those of skill in the art upon examination of the description. It should be understood, however, that the scope of the claims should not be limited by the embodiments, but should be given the broadest interpretation consistent with the wording of the claims and the specification as a whole.

The invention claimed is:

1. A system for monitoring and/or improving stretch film usage in a pallet wrap machine, the system comprising:

a plurality of rotary encoders configured to be contactable with stretch film in a pallet wrap machine, at least one of the plurality of rotary encoders configured to contact unstretched stretch film and at least one of the plurality of rotary encoders configured to contact stretched stretch film in the pallet wrap machine; and, a controller in communication with the plurality of rotary encoders, the controller configured to receive rotational data generated by rotation of the rotary encoders, wherein the rotation of the rotary encoders is caused by engagement of the rotary encoders with the stretch film moving in the machine and the rotational data from any one rotary encoder is correlated to a length of stretch film that has passed by the any one rotary encoder, and wherein an amount of stretch film pulled off a roll of stretch film in the machine is determined by a computer from rotational data from the at least one rotary encoder configured to contact unstretched stretch film and/or an amount of stretching of the stretch film is determined by the computer by comparing the rotational data from the at least one rotary encoder configured to contact unstretched stretch film to rotational data from the at least one rotary encoder configured to contact stretched stretch film.

2. The system according to claim 1, wherein the plurality of rotary encoders is two rotary encoders comprising a first rotary encoder configured to contact unstretched stretch film and a second rotary encoder configured to contact stretched stretch film.

3. The system according to claim 1, wherein the rotary encoders are configured to be contactable with the stretch film by mounting rotary encoder assemblies comprising the rotary encoders on mounting structures connected to one or more rollers in the machine.

4. The system according to claim 3, wherein the rotary encoder assemblies are spring-loaded to engage the rotary encoders with the stretch film during operation of the machine while permitting movement of the rotary encoders so that replacement of the roll of stretch film is unimpeded by the rotary encoders.

5. The system according to claim 1, wherein the controller comprises a programmable logic controller.

6. The system according to claim 1, wherein the computer further comprises a non-transient electronic storage medium for storing the rotational data.

7. The system according to claim 6, wherein the computer comprises a remote computer and the system further comprises means for transmitting the rotational data to the remote computer.

8. The system according to claim 1, wherein the computer comprises a remote computer and the system further comprises means for transmitting the rotational data to the remote computer.

9. A method for monitoring and/or improving stretch film usage in a pallet wrap machine, the method comprising:

obtaining rotational data from a plurality of rotary encoders engaged with stretch film in a pallet wrap machine, at least one of the plurality of rotary encoders engaged with unstretched stretch film and at least one of the plurality of rotary encoders engaged with stretched stretch film in the pallet wrap machine;

determining lengths of stretch film that have passed the rotary encoders from the rotational data; and, determining whether a roll of stretch film needs to be replaced from the length of stretch film that has passed the at least one rotary encoder engaged with unstretched stretch film, and/or determining whether stretch film usage is optimal by comparing the length of stretch film that has passed the at least one rotary encoder engaged with unstretched stretch film to the length of the stretch film that has passed by the at least one rotary encoder engaged with stretched stretch film.

10. The method according to claim 9, wherein the plurality of rotary encoders is two rotary encoders comprising a first rotary encoder configured to contact unstretched stretch film and a second rotary encoder configured to contact stretched stretch film.

11. The method according to claim 9, wherein the lengths of stretch film that have passed by the rotary encoders are compared to benchmark values for an amount of stretch film that is expected to be used for the type of product or palletized load being wrapped.

12. A kit for retrofitting a pallet wrap machine with a system for monitoring and/or improving stretch film usage in the pallet wrap machine, the kit comprising:

a plurality of rotary encoders;

a controller configured to be interfaced with the rotary encoders and programmed with software to interpret rotational data from the rotary encoders to produce logs based on the rotational data; and, instructions for installing the plurality of rotary encoders on the machine so that at least one of the plurality of rotary encoders is configured to contact unstretched stretch film and at least one of the plurality of rotary encoders is configured to contact stretched stretch film in the pallet wrap machine, and instructions for configuring the controller to be in communication with the rotary encoders.

13. The kit according to claim 12, further comprising an encoder interface for receiving the rotational data from the rotary encoders through wires and for wirelessly transmitting the rotational data to the controller, one or more cable harnesses for routing the wires from the rotary encoders to the encoder interface, and instructions for installing the encoder interface and the one or more cable harnesses.

14. The kit according to claim 12, wherein the controller is programmed to continuously or periodically send the rotational data to an off-site controller, data logger and/or user interface.

* * * * *